US006375454B1

(12) United States Patent
Jacobsen et al.

(10) Patent No.: US 6,375,454 B1
(45) Date of Patent: Apr. 23, 2002

(54) CONTROLLABLE COMBUSTION DEVICE

(75) Inventors: Stephen C. Jacobsen; Clark C. Davis, both of Salt Lake City, UT (US)

(73) Assignee: Sarcos, L.C., Salt Lake City, UT (US)

( * ) Notice: Subject to any disclaimer, the term of this patent is extended or adjusted under 35 U.S.C. 154(b) by 0 days.

(21) Appl. No.: 09/439,473

(22) Filed: Nov. 12, 1999

(51) Int. Cl.[7] ..... F23D 14/22

(52) U.S. Cl. ..... 431/1; 431/2; 431/12; 431/72; 431/254; 431/281; 431/353

(58) Field of Search ..... 431/1, 2, 6, 12, 431/72, 74, 254, 281, 285, 353; 239/418, 423

(56) References Cited

U.S. PATENT DOCUMENTS

| | | | | |
|---|---|---|---|---|
| 1,983,405 A | | 12/1934 | Schmidt | |
| 2,480,281 A | * | 8/1949 | Begerow | 431/281 |
| 2,496,502 A | * | 2/1950 | Steensma | 431/74 |
| 2,525,782 A | | 10/1950 | Dunbar | |
| 2,539,535 A | | 1/1951 | Espenschied | |
| 2,549,464 A | | 4/1951 | Hartley | |
| 2,573,697 A | | 11/1951 | Dunbar et al. | |
| 2,581,669 A | | 1/1952 | Kadenacy | |
| 2,647,365 A | | 8/1953 | Myers | |
| 2,838,102 A | | 6/1958 | Reimers | |
| 3,093,962 A | | 6/1963 | Gluhareff | |
| 3,393,964 A | * | 7/1968 | Donnelly | 431/2 |
| 3,395,967 A | | 8/1968 | Karr | |
| 3,473,879 A | * | 10/1969 | Berberich | 431/1 |
| 3,545,211 A | | 12/1970 | Harp, Jr. | |
| 3,656,878 A | * | 4/1972 | Wright | 431/353 |
| 3,954,380 A | | 5/1976 | Valaev et al. | |
| 5,000,677 A | * | 3/1991 | Lathion et al. | 239/418 |
| 5,123,835 A | | 6/1992 | Richards et al. | |
| 5,302,112 A | * | 4/1994 | Nabors, Jr. et al. | 239/418 |

OTHER PUBLICATIONS

Borman, G. and Ragland, K., Combustion Engineering, Boston, WCB McGraw–Hill, 1998, p. 25.*

Turns, S., An Introduction to Combustion. N.Y., McGraw–Hill Inc., 1996. p. 6.*

* cited by examiner

*Primary Examiner*—Sara Clarke
(74) *Attorney, Agent, or Firm*—Thorpe North & Western, LLP

(57) ABSTRACT

A combustion device for providing a stream of combustion products. In particular, there is a combustion device, utilizing micro-sized combustion tubes, that can 1) control firing profiles of an array of combustion tubes, 2) control acoustics generated thereby, and 3) provide an exhaust gas for actuating an attached device, like a piston. The array of combustion tubes is individually controlled. Wherein the array of tubes comprises either uniformly dimensioned tubes or is formed of a variety of dimensions, like length and diameter, which are arranged in selected patterns. There can be either a single ignition point at an end of the combustion tubes, or a multiple of ignition points positioned along the interior length of the tubes. There is also a combustion sequence that self extinguishing after burning all of the fuel in the combustion tube at the end of each cycle.

27 Claims, 2 Drawing Sheets

CONTROLLABLE COMBUSTION DEVICE

BACKGROUND OF THE INVENTION

1. Field of the Invention

This invention relates to a combustion device. In particular, there is a combustion device, utilizing micro-sized combustion tubes, that can 1) control firing profiles of an array of combustion tubes, 2) control a variety of configurations of applied force generated thereby, and 3) provide an exhaust gas for actuating an attached device, like a piston.

2. Description of the Prior Art

The background art shows a variety of related designs using combustion, which are made to harness the power generated therefrom. Examples of patents related to the present invention are as follows, and each patent is herein incorporated by reference for the supporting teachings:

U.S. Pat. No. 5,123,835, is a pulse combustor with controllable oscillations.

U.S. Pat. No. 3,954,380, is a method and apparatus for intermittent combustion.

U.S. Pat. No. 3,545,211, is a resonant pulse rocket

U.S. Pat. No. 3,395,967, is a method and device for supplying a magnetohydrodynamic generator.

U.S. Pat. No. 3,093,962, is a valveless jet engine with inertia tube.

U.S. Pat. No. 2,838,102, is a pulse jet burner system.

U.S. Pat. No. 2,647,365, is a reso-jet motor.

U.S. Pat. No. 2,581,669, is a gas turbine power plant with tank supplied by long conduit having volume over six times that of the intermittent combustion gas generator.

U.S. Pat. No. 2,573,697, is a multi-tube mosaic reso-jet motor.

U.S. Pat. No. 2,549,464, is an electric power source.

U.S. Pat. No. 2,539,535, is a source of electrical energy.

U.S. Pat. No. 2,525,782, is a shock wave trap for multiple combustion chamber reso-jet motor.

U.S. Pat. No. 1,983,405, is a method of producing motive forces on aircraft, by the explosion of inflammable mixtures of substances.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

3. Problems with the Prior Art

Heretofore, there has never been a combustion device, utilizing micro-sized combustion tubes, that can 1) control firing profiles of an array of combustion tubes, 2) control variety of configurations of applied force generated thereby, and 3) provide an exhaust gas for actuating an attached device, like a piston. Therefore, there is a need for a combustion device that provides for control of firing profiles, and attached devices.

SUMMARY OF THE INVENTION

It is a feature of the invention to provide a combustion device for providing a stream of combustion products. In particular, there is a combustion device, utilizing micro-sized combustion tubes, that can 1) control firing profiles of an array of combustion tubes, 2) control acoustics generated thereby, and 3) provide an exhaust gas for actuating an attached device, like a piston.

A further feature of the invention is to provide an array of combustion tubes that are individually controlled. Wherein the array of tubes comprise either uniformly dimensioned tubes or are formed of a variety of dimensions, like length and diameter, which are arranged in selected patterns.

An additional feature of the invention is to provide either a single ignition point at an end of the combustion tubes, or provide for multiple ignition points positioned along the interior length of the tubes.

A further feature of the invention is to provide for a combustion sequence that self extinguished after burning all of the fuel in the combustion tube.

The invention resides not in any one of these features per se, but rather in the particular combination of all of them herein disclosed and claimed and it is distinguished from the prior art in this particular combination of all of its structures for the functions specified. Other features of the present invention will become clearer from the following detailed description of the invention, taken with the accompanying drawings and claims, or may be learned by the practice of the invention.

There has thus been outlined, rather broadly, the more important features of the invention so that the detailed description thereof that follows may be better understood, and so that the present contribution to the art may be better appreciated. There are, of course, additional features of the invention that will be described hereinafter which would form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims are regarded as including such equivalent constructions insofar as they do not depart from the spirit and scope of the present invention.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings. Like numbering between figures represent like elements.

DETAILED DESCRIPTION OF THE PREFERRED EMBODIMENT

Figure 1:
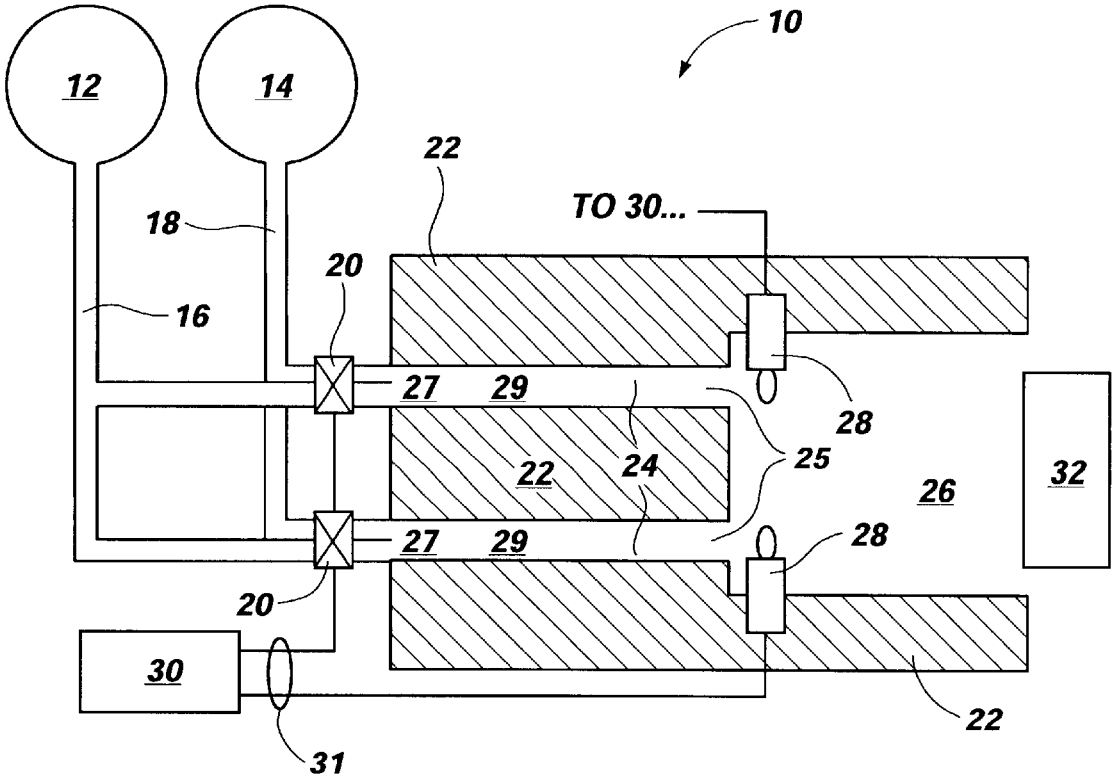
FIG. 1 is a schematic representation of a preferred embodiment of the invention.

Referring to FIG. 1, there is a schematic representation of a preferred embodiment of the invention. Specifically, there is a combustion device 10, having a first and second fuel reservoir (or tanks) 12 and 14 that are coupled to fuel lines 16 and 18 respectively. There is an optional valve 20 that may be coupled to one or both fuel lines. Housing 22 may be used to support combustion tube 24 and to maintain an optional chamber 26. Tubes 24 are divided into several sections, an extinguishing end or section 27, igniter tube ends 25, or igniter section, and combustion section 29. Igniter 28 are located at igniter tube end 25. Control 30 is electrically coupled to valve 20 and igniter 28 via lines 31. An actuatable object 32, for example a piston, may be located proximate chamber 26.

In operation of the embodiment illustrated in FIG. 1, combustion device 10 transports fuel from tanks 12 and 14 via line 16 and 18 to tubes 24. The fuels are selected so that they are not combustible until they become a mixed fuel in tubes 24. Tubes 24 will gradually fill with the mixed fuel, filling from the extinguishing ends 27 to the igniting ends 25. The mixed fuel will not be ignited until tubes 24 are completely full and the mixed fuel reaches igniters 28. Upon ignition by igniters 28 the mixed fuel will not instantaneously and completely combust. The parameters of the combustion device are selected so that the mixed fuel will first combust near the ignition point, at igniter 28, and sequentially combust the mixed fuel back through tube 24 until combustion has reached extinguishing ends 27. Upon reaching extinguishing ends 27, and since the unmixed fuels are selected for not combusting until after they are mixed, once the combustion process has combusted all of the mixed fuel located in tube 24, the combustion process will be self extinguished at extinguishing ends 27. Meanwhile, as the mixed fuel is being combusted, the expanding exhaust from the combustion process will be propelled out of tubes 24 and into chamber 26, thereby increasing the pressure located therein. The pressurization of chamber 26 can be used to actuate the actuatable object 32, which could be a piston.

Figure 2:
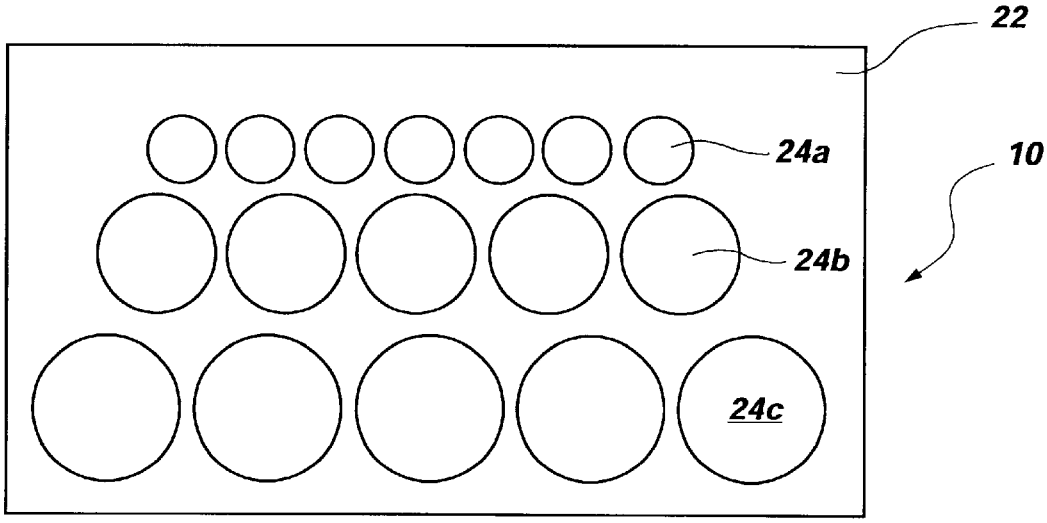
FIG. 2 is an end view of one embodiment of a possible arrangement for an array of varied diameter combustion tubes.

Referring to FIG. 2, there is an end view of one embodiment of a possible arrangement for an array of varied diameter combustion tubes. Uniquely, there is illustrated a first row of tubes 24*a*, which are the smallest in diameter, a second row of tubes 24*b*, which are larger in diameter than tubes 24*a*, and a third row of larger tubes 24*c*, which has the largest diameter. Typical diameters for the combustion device ranges from 2 millimeters down to a range of 100 microns and less.

Figure 3:
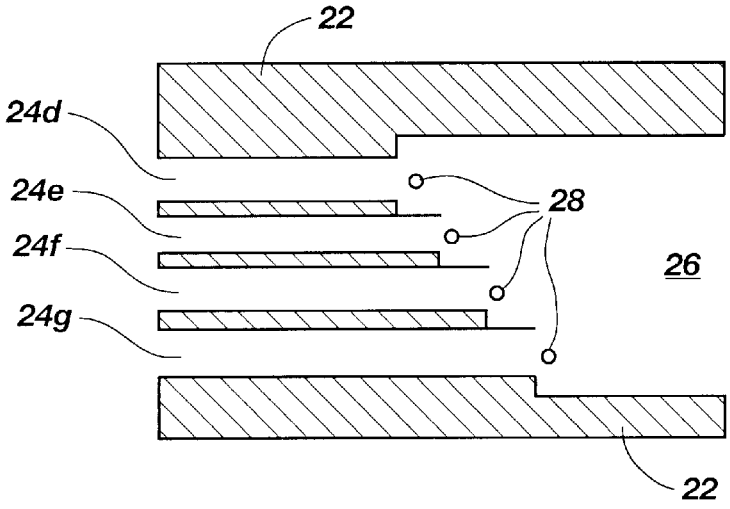
FIG. 3 is a side view of one embodiment of a possible arrangement for an array of varied length combustion tubes.

Referring to FIG. 3, there is a side view of one embodiment of a possible arrangement for an array of varied length combustion tubes. Uniquely, there is illustrated a first row of tubes 24*d*, which are the smallest in length, a second row of tubes 24*e*, which are larger in length than tubes 24*d*, a third row of larger tubes 24*f*, which has an even larger length, and a fourth row of the largest tubes 24*g*. Typical lengths for the tubes could range from 1 mm to 20 cm.

Figure 4:
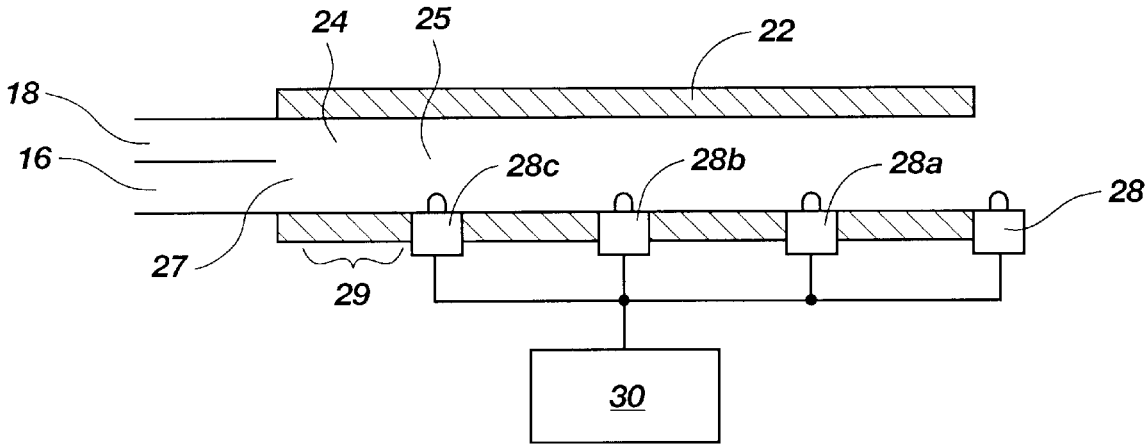
FIG. 4 is a side view of one embodiment of a possible arrangement for a combustion tube with variable ignition device placements.

Referring to FIG. 4, there is a side view of one embodiment of a possible arrangement for a combustion tube 24 with variable ignition device 28 placements. Uniquely, it is now possible to vary the effective length of tube 24 by having selective locations for ignition. Specifically, the extinguishing section 27 is in a fixed location next to the fuel lines 16 and 18, but depending upon which igniter is fired, the igniter section 25 will change position, and the combustion section 29 will correspondingly vary. For example, if igniter 28*c* were activated, the combustion process would begin when only about a quarter of the tube is filled with mixed gas, and the respective igniter section 25 is located at igniter 28*c*, while combustion section 29 is only about on quarter the length of the whole tube.

REMARKS ABOUT THE PREFERRED EMBODIMENT(S)

One of ordinary skill in the art of designing combustion tubes, creating firing profiles, or creating acoustics using combustion will realize many advantages from using the preferred embodiments taught herein. For example, by providing a large array of tubes using the various embodiments taught herein, a very sophisticated firing profile can be produced. Specifically, it would be possible to drive a piston at variable rates of speed based upon the number of tubes used and the intensity of the combustion produced in the selected tubes.

The embodiment of FIG. 2 illustrates several key concepts about combustion device 10. First, it is conceived to use an array of tubes 24, which may have the same or a variety of diameters. An array of tubes will allow for the generation of what can be referred to as a firing profile. A firing profile can be generated by controlling the firing of individual tubes in the array the flow rate of fuel and varying the sequential timing of the firing. For example, one firing profile could be to fire, or ignite, only the tubes that are located around the periphery of the array. Another profile, could be, first firing the periphery tubes and then sequentially firing the next inner periphery layer of tubes towards the center of the array, and continue firing progressive layers until reaching the center tubes. Many combinations can be imagined, like only firing the top half all at once, or only firing the largest diameter tubes.

It is noted that to achieve certain firing profiles, controller 30 will be used to sequence the igniters 28 and potentially regulating the flow of fuel into respective tubes by sequencing valves 20 to open and close appropriately. Thus, by using an array of tubes, a firing profile can generate many different pressure or acoustic wave patterns that are exhausted from the array.

Referring to FIG. 3, as with the teachings from FIG. 2, the key idea taught by using variable length tubes 24 is that any arrangement of tube lengths can be used for an array. Thus, different firing profiles may be achieved by using not only different diameter tubes, but also by using different lengths of tubes or a combination of both variables. Therefore, different pressure or acoustic wave sequences can be achieved by controlling the firing profiles for various designs of arrays having varieties of lengths and diameters.

Referring to FIG. 4, a skilled artisan will easily realize that if the pressure or acoustic wave to be produced is to be less than what a fully fueled tube would produce, then any of the intermediate igniters 28*a–c* could be activated by controller 30. Whereby, a lower pressure exhaust or a different acoustic wave would be developed. A skilled artisan would also realize that depending upon which igniter is activated, there will be a portion of the tube that does not contain any mixed fuel. That unmixed fuel portion of the tube could act as an additional control parameter such as a resonant chamber. Thus, different resonant frequencies can be produced depending upon the location and timing of the igniter.

In reference to all of the above described embodiments, by using the variability of the tube design parameters taught above, and knowing that each tube will create a certain harmonic acoustic frequency, it would be possible to play whole musical pieces through the control unit 30. It would even be possible to have a user interface that would control which tube to be fired, much like a piano player controls which notes are to be activated.

Although it is taught to use a piston 32 with the preferred embodiment, a skilled artisan would easily understand that there are many different devices that could utilize the power generated by the combustion exhaust from tubes 24. For example, a circular vane pump or generator could be actuated in this fashion. Additionally, the hot exhaust gas could be used to heat something in a controlled manner. The acoustic waves of the exhaust could be used to excite a resonant piezoelectric structure to generate electricity. Moreover, the tubes produce light that could be used for any number of uses, like light shows.

A second advantage from having tubes that are of a micro-size is that there is virtually an elimination of side leakages that could prevent the extinguishing of the combustive process upon burning of the mixed fuel. Specifically, larger tubes will combust the fuel in the center and thus create channels along the sides of the tube that are not combusted and actually could be drawing air therein along those channels. Therefore, by using tubes that are 2 millimeters to 100 microns and smaller, there is an elimination of the inefficiencies of prior art larger tubes. Thus, the smaller tubes will self extinguish upon burning all of the mixed fuel when the combustion reaches the extinguishing end of the tube.

VARIATIONS OF THE PREFERRED EMBODIMENT(S)

A skilled artisan would consider it a simple design modification to provide any number of igniters 28 along the longitudinal axis of the tube to provide a wider range of firing profile generation. Additionally, a skilled artisan would easily consider firing all tubes 24 at once after completely filling the tubes for a maximum amount of generated exhaust force. Also, one skilled in the art would understand that the amount of pressure in the tanks will control the rate of flow of the fuel, and thus control the rate at which the tube will fill with the mixed fuel. Although skilled artisans will know of many other ways to vary the rate of fuel mixture, for example the valve could change the size of an orifice to increase the rate of flow.

Although FIG. 2 illustrates a particular pattern of tube diameters, this embodiment illustrates the concept of designing many different arrangements for a variety of tube diameters. For example, different diameter tubes could be placed in groups, where each grouping could have one tube of each diameter. Additionally, it is contemplated to have the outer periphery of the array designed with the smallest diameter and progressively increase the diameters until reaching the center, which would have the largest diameter. The key idea is that any arrangement of tube diameters for the array is possible to provide for a variety of firing profiles.

Although each embodiment is illustrated separately, it is within the ability of one skilled in the art of micro-scale combustion to understand the ease of combining various combinations of the embodiments into a single combustion device. For example, it could be possible to have variable diameter tubes having igniters placed along their longitudinal axis. Additionally, the array of tubes could have some of the tubes located within other tubes in a concentric pattern appearing like a bulls-eye when looking down the center of the tubes.

It is even contemplated to assemble the combustion device in various other ways. For example, although a supporting housing 22 is illustrated, it may not be necessary for the assembly if the tubes are sufficiently rigid, or only the outer tubes may be supported by a periphery housing. Additionally, although cavity 26 is illustrated, it may not be needed for all applications, like an acoustic wave generator may operate better with no cavity. Also, controller 30 is generally designed to be similar to a central processing unit, which could have many other functions. For example, if an operator wanted to control the sequencing of the tube firing, a keyboard could be part of control unit 30 to allow for easy operator control.

It is contemplated to use the present invention in a number of applications. For example, by coupling the present invention to a heat exchanger the heated exhaust is used to causes phase transition of a material like Freon, which in turn can be coupled to a actuated device like a piston. The invention could also be used for light sources that have soft beautiful glowing. A panel of the tube arrays would be 100 microns thick and any number of feet in surface area. All the lighting would be run on propane or other fuels. The invention may also find application in the heat transfer technology. For example, it could replace large central furnaces in homes and place the micro-combustion chambers in the location where heat is desired. Specifically, covering a surface of a wall 33 that is exposed to a building's outside surface, or be positioned along base boards all around a house, or be next to windows where the R-factor is very low and a lot of building heat is lost to the outside. Another application for the present invention involves a method for heating water. For example, instead of having a large hot water heater in a home, a heat exchanger could be made that measures four inches in diameter and six inches in length. Where pumping water through the exchanger that has a very large surface area in a small space would create heated water by the time the water reaches the end of the length of the exchanger.

Although the preferred embodiment illustrates actuation of a piston, it is contemplated to actuate any actuatable device. For example, a rotating device like a fan or band valves.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Patent is:

1. A combustion device, comprising:

at least one combustion tube having an extinguishing section and an igniter section and a combustion section intermediate the extinguishing section and the igniter section;

an igniter adjacent the igniter section;

a first line and a second line in communication with the combustion tube adjacent the extinguishing section, said lines being configured to convey a first material and a second material respectively to the combustion tube, said first and second materials being combustible when combined to form a combustible mixture in the combustion tube, but not combustible individually before such combination;

the combustion device being configured to provide for the combustible mixture to fill the combustion tube from the extinguishing section toward the igniter section and to be ignited by the igniter adjacent the igniter section, combustion proceeding through the combustion section from the ignition section toward the extinguishing section and then extinguishing.

2. The combustion device of claim 1, wherein at least one of the first and second lines is controlled by a valve configured for controlling material flow into the combustion tube.

3. The combustion device of claim 2, further comprising a housing to support the tube, wherein the housing includes a chamber, located to receive exhaust gas from the tube after combustion.

4. The combustion device of claim 3, further comprising an actuatable object, located proximate the chamber.

5. The combustion device of claim 4, wherein an exhaust from the tube is used to actuate the actuatable object.

6. The combustion device of claim 1, further comprising a controller electrically coupled to the valve and igniter.

7. The combustion device of claim 1, wherein the tube ranges in diameter form two millimeters to less than 100 microns.

8. The combustion device of claim 1, further comprising at least one additional combustion tube, the combustion tubes forming an array of combustion tubes, each coupled to the first and second lines and to an individual igniter.

9. The combustion device of claim 8, each tube having the same diameter.

10. The combustion device of claim 8, wherein the array of tubes comprises at least two different diameters.

11. The combustion device of claim 8, wherein each tube ha s the same length, said length ranging from one millimeter to twenty centimeters.

12. The combustion device of claim 8, wherein the array of tubes comprises tubes of at least two different lengths, said lengths ranging from one millimeter to twenty centimeters.

13. The combustion device of claim 8, wherein the array of tubes has at least one tube having at least two igniters located along a longitudinal axis of the tube.

14. The combustion device of claim 8, wherein the array of tubes generate a pattern of acoustic waves.

15. The combustion device of claim 1, wherein the tube has at least two igniters located along a longitudinal axis of the tube.

16. The combustion device of claim 1, wherein the tube generates an acoustic wave.

17. The combustion device of claim 1, wherein an exhaust is used to heat an object.

18. The combustion device of claim 1, wherein the exhaust is used to heat structure that houses the combustion device.

19. The combustion device of claim 1, wherein the exhaust is used to produce electricity.

20. The combustion device of claim 1, wherein the combustion device is used to create light.

21. The combustion device of claim 1, wherein the combustion device is placed on a portion of a wall to heat a room.

22. A method for operating a combustion device, comprising the following steps:

providing a first material and a second material that are selected so that they are not combustible until they are mixed;

filling a tube, from an extinguishing section, with the first and second materials to form a combustible mixture;

igniting the combustible mixture in the tube, at an ignition section that is spaced from the extinguishing section, after a portion of the tube is filled with the combustible mixture;

sequentially combusting the combustible mixture back through the tube from the ignition section to the extinguishing section, until combustion has reached the extinguishing section;

self extinguishing the combustion at the extinguishing section; and expelling expanding exhaust, from the combustion process, out of the tube.

23. The method of claim 22, further comprising the step of using the exhaust to actuate an actuatable object.

24. The method of claim 22, further comprising the step of using the exhaust is used to heat an object.

25. The method of claim 22, further comprising the step of using the exhaust is used to heat a structure that houses the combustion device.

26. The method of claim 22, further comprising the step of using the exhaust is used to produce electricity.

27. The method of claim 22, further comprising the step of using the combustion device to create light.

* * * * *

UNITED STATES PATENT AND TRADEMARK OFFICE

CERTIFICATE OF CORRECTION

PATENT NO. : 6,375,454 B1 
DATED : April 23, 2002
INVENTOR(S) : Stephen C. Jacobsen and Clark C. Davis It is certified that error appears in the above-identified patent and that said Letters Patent is hereby corrected as shown below:

Title page,
Item [57], ABSTRACT,
Last sentence, "extinguishing" should be replaced with -- extinguishes --, Column 1,
Line 57, "variety" should be replaced with -- a variety --, Column 4,
Line 22, the "," immediately following "Another profile" should be deleted, Column 6,
Line 9, "causes" should be replaced with -- cause --, Column 7,
Line 18, "from" should be replaced with -- form --,
Line 29, "ha s" should be replaced with -- has --, Column 8,
Line 35, "is used" should be deleted,
Line 37, "is used" should be deleted,
Line 40, "is used" should be deleted.

Signed and Sealed this

Third Day of December, 2002

JAMES E. ROGAN
*Director of the United States Patent and Trademark Office*